US008646154B2

(12) United States Patent
Smith

(10) Patent No.: US 8,646,154 B2
(45) **Date of Patent: *Feb. 11, 2014**

(54) ADJUSTABLE DOOR STOP SYSTEM

(76) Inventor: B. Jack Smith, Bixby, OK (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/437,044

(22) Filed: Apr. 2, 2012

(65) Prior Publication Data

US 2012/0186043 A1 Jul. 26, 2012

Related U.S. Application Data

(62) Division of application No. 12/579,773, filed on Oct. 15, 2009, now Pat. No. 8,156,613.

(51) Int. Cl.
*E05D 11/06* (2006.01)

(52) U.S. Cl.
USPC ..... 16/375; 16/376; 16/374

(58) Field of Classification Search
USPC ..... 16/82, 374, 375, 286, 376, 377, 386, 16/262, 265; 292/298, 341.18, DIG. 17
See application file for complete search history.

(56) References Cited

U.S. PATENT DOCUMENTS 2,660,750 A * 12/1953 Wallen ..... 16/50
3,913,171 A * 10/1975 Reid ..... 16/375
5,145,076 A * 9/1992 Murphy et al. ..... 213/155
5,630,519 A * 5/1997 Burke et al. ..... 213/155
6,497,005 B2 * 12/2002 Apostoloff ..... 16/375
7,197,791 B1 * 4/2007 Smith ..... 16/375
2010/0251520 A1 * 10/2010 Corso et al. ..... 16/342

FOREIGN PATENT DOCUMENTS

DE 202004008016 U1 * 4/2005

* cited by examiner

*Primary Examiner* — Chuck Mah

(74) *Attorney, Agent, or Firm* — Head, Johnson & Kachigian, P.C.

(57) ABSTRACT

An adjustable door stop system. The system includes a hinge pin having an axis about which the hinge leaves rotate, a top end, and an opposed bottom end. In one embodiment, a hinge pin cap has a first portion extending radially from the top end of the hinge pin and a second cylindrical portion extending from the first portion parallel to the access of the hinge pin. A control cap has an opening to receive the hinge pin therethrough, the control cap having a radially extending first portion and a cylindrical second portion substantially parallel to the axis of the hinge pin. A mechanism is provided to prevent movement of the hinge pin cap with respect to the control cap including a plurality of teeth on the control cap second cylindrical portion and a plurality of teeth of the control cap cylindrical portion which mate with each other.

8 Claims, 7 Drawing Sheets

ADJUSTABLE DOOR STOP SYSTEM

CROSS-REFERENCE TO PENDING APPLICATIONS

This application is a divisional application of U.S. patent application Ser. No. 12/579,773, filed Oct. 15, 2009 entitled "Adjustable Door Stop System".

BACKGROUND OF THE INVENTION

1. Field of the Invention

The present invention relates to an adjustable door stop system that may be utilized with hinge mounted doors in order to stop movement of the door from moving past a selected position. In particular, the present invention relates to an adjustable door stop system that may be easily adjusted to various positions and will not mar or damage the door and will not mar or damage an adjacent wall or woodwork.

2. Prior Art

Various types of door stops are known to prevent opening doors from causing damage to doors, to door knobs or to adjacent walls or doorways.

While some existing door stops require special hinge leaves, present invention in directed to a door stop system and a method that may be utilized and added to almost any standard, existing, hinge mounted door.

One known popular type of door stop is held in place by a hinge pin and includes a padded, adjustable post that rests against the doorway on one side and a padded post that rest against the door on the other side. While this functions adequately for its intended purpose, continual pressure by the post against a hollow core door will often result in damage to the door.

Applicant's prior adjustable door stop, shown and disclosed in U.S. Pat. No. 4,998,941 entitled "Adjustable Door Stop," addresses and solves this problem. Applicant's prior door stop provides an adjustable door stop that will not impact against the door at all and will therefore avoid any damage to the door.

Applicant's prior adjustable door stop system, shown and disclosed in U.S. Pat. No. 7,197,791 entitled "Adjustable Door Stop System" provides a further adjustable door stop system that may be utilized to stop movement of the door at a selected position.

The present invention is directed to a further adjustable door stop system. The present invention provides yet a further solution to address the forgoing problems.

Accordingly, a principal object and purpose of the present invention is to provide an adjustable door stop system that will neither mar nor damage a doorway or a wall adjacent to a doorway.

It is a further object and purpose to the present invention to provide an adjustable door stop system that may be utilized with a wide variety of hinge mounted doors.

It is further object and purpose of the present invention to provide an adjustable door stop system that may be readily adapted to new construction and to existing hinge mounted doors.

It is a further object and purpose to the present invention to provide an adjustable door stop system where a hinge pin or hinge leaves are prevented from axial movement beyond a desired amount.

It is a further object and purpose of the present invention to provide an adjustable door stop system that interfaces and operates with the hinges connected to the door and the doorway and will not touch or interface with the door or the doorway at all.

It is a further object and purpose of the present invention to provide an adjustable door stop system that may be readily and quickly adjusted to adjust the permissible opening of the door with respect to the doorway.

SUMMARY OF THE INVENTION

The present invention is directed to an adjustable door stop system. The system includes a hinge pin with a cylindrical barrel having an axis so that hinge leaves rotate around the axis.

A hinge pin cap extends from and is attached to a top end of the hinge pin. The hinge pin cap has a first portion extending radially from the top end of the hinge pin perpendicular to the axis of the hinge pin. The hinge pin cap also includes a second cylindrical portion extending from the first portion parallel to the axis of the hinge pin. The second portion does not completely encircle the hinge pin so that the edges form shoulders.

A control cap includes a central opening to receive the hinge pin therethrough. The control cap also includes a first portion radially extending from the central portion and a second portion extending cylindrically from the first portion wherein the second portion is substantially parallel to the axis of the hinge pin. The second portion does not completely encircle the hinge pin so that the edges form shoulders.

A mechanism is provided to prevent movement of the hinge pin cap with respect to the control cap. A plurality of teeth on the inside surface of the hinge pin cap second cylindrical portion engage and mate with a plurality of teeth on the exterior surface of the control cap cylindrical portion.

The hinge pin cap and the control cap operate together to stop and arrest movement of the door at a desired, selected position prior to either the door or an adjacent wall or doorway being marred.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

Figures 1, 2:
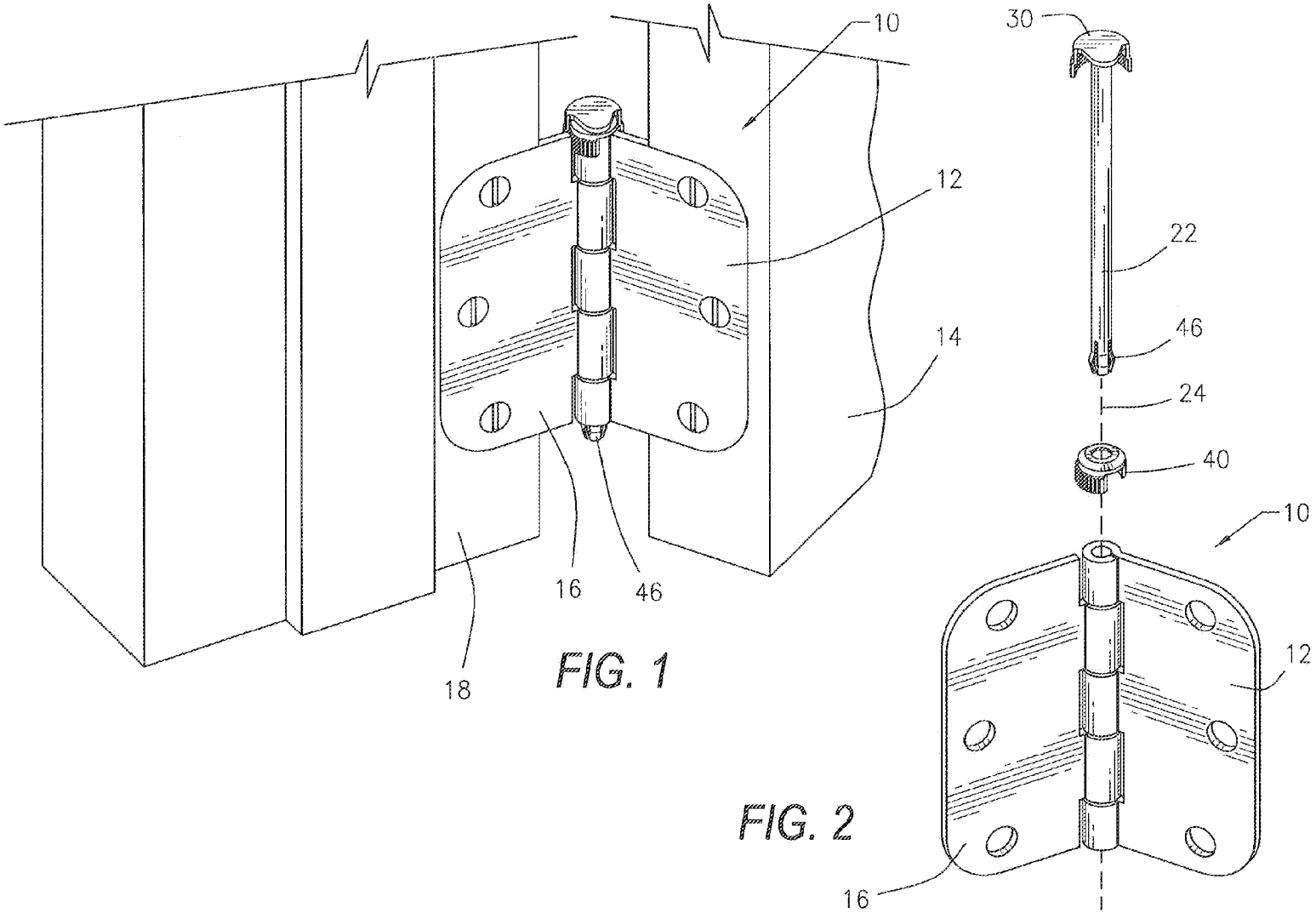
FIG. 1 illustrates a perspective view of first preferred embodiment of an adjustable door stop system constructed in accordance with the present invention.
FIG. 2 illustrates an exploded view of the adjustable door stop system shown in FIG. 1 apart from the door and the doorway.

FIG. 1 illustrates a perspective view of a first preferred embodiment 10 of an adjustable door stop system constructed in accordance with present invention for a hinge mounted door and FIG. 2 illustrates an exploded view of an adjustable door stop system 10 shown in FIG. 1 apart from the door and doorway.

One hinge leaf 12 would be connected to a door 14 in a known manner, such as with fasteners. Another hinge leaf 16 would be connected to a doorway 18 in a known manner, such as with fasteners. The present invention may be employed with a wide variety of doors and doorways.

The adjustable door stop system includes a hinge pin 22 with a cylindrical barrel having an axis (illustrated by dashed lines 24 in FIG. 2) so that the hinge leaves rotate around the axis 24.

Figure 3:
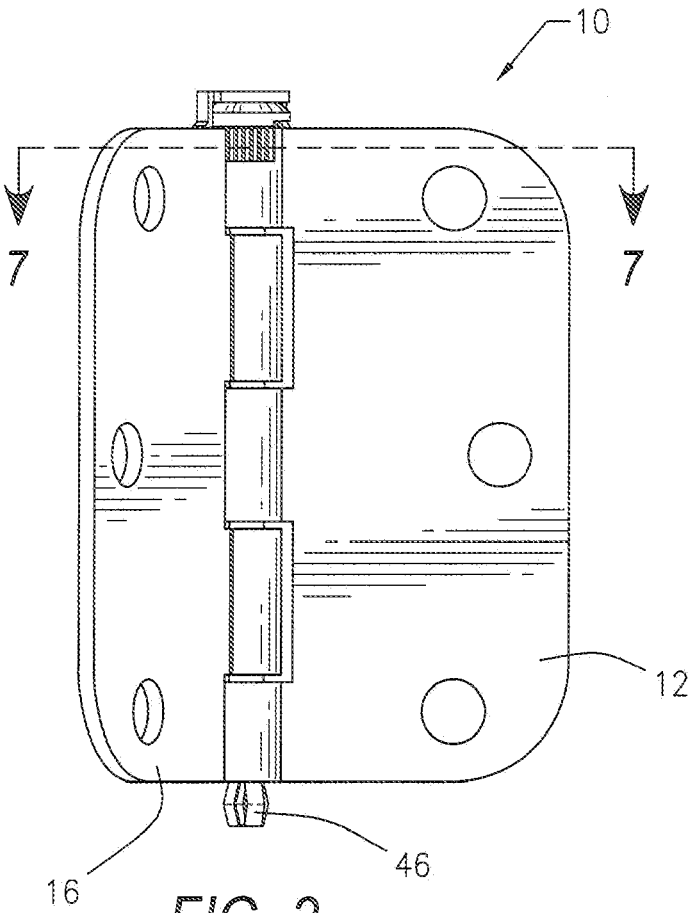
FIG. 3 illustrates a perspective view of the adjustable door stop system shown in FIG. 1 apart from the door and the doorway.
Figure 5:
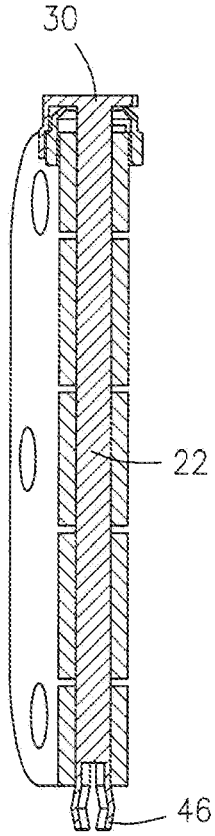
FIG. 5 illustrates a sectional view taken along section line 5-5 of FIG. 4.
Figure 4:
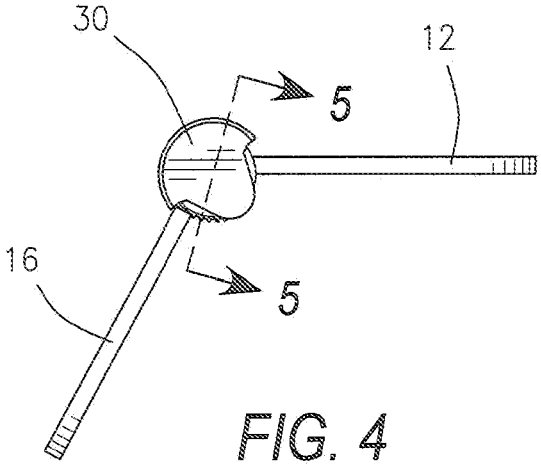
FIG. 4 illustrates a top view of the adjustable door stop system show in FIG. 3.

FIG. 3 illustrates a perspective view of the assembled adjustable door stop system 10 apart from the door and the doorway. FIG. 4 illustrates a top view of the adjustable door stop system 10 shown in FIG. 3 and FIG. 5 illustrates a sectional view taken along section line 5-5 of FIG. 4. A hinge pin cap 30 extends from and is attached to the top end of the hinge pin 22. The hinge pin cap 30 may be integrally formed with the hinge pin 22 or may be attached thereto.

The hinge pin cap 30 has a first portion 32 extending radially from the top end of the hinge pin. Accordingly, the first portion 32 is perpendicular to the axis 24 of the hinge pin. The hinge pin cap 30 also includes a second cylindrical portion extending from the first portion 32 parallel to the axis of the hinge pin 22. The second portion does not completely encircle the hinge pin 22 so that the edges form shoulders.

A control cap 40 includes a central opening to receive the hinge pin 22 therethrough. The control cap 40 also includes a first portion radially extending from the central opening and a second portion extending cylindrically from the first portion wherein the second portion is substantially parallel to the axis of the hinge pin 22. The second portion does not completely encircle the hinge pin 22 so that the edges form shoulders.

The diameter of the second portion of the hinge pin cap 30 is slightly larger than the diameter of the second portion of the control cap 40.

Figure 6:
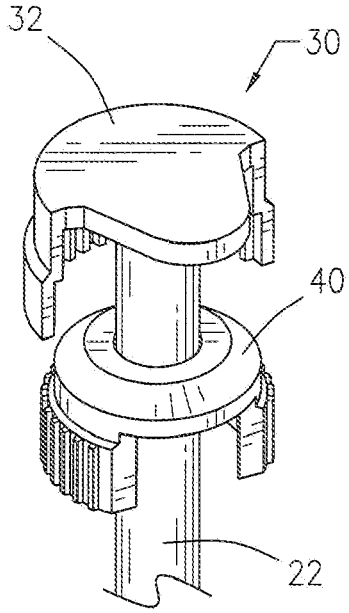
FIG. 6 illustrates a hinge pin and a control cap of the adjustable door stop system shown in FIG. 1.

FIG. 6 illustrates a portion of the hinge pin 22 with the hinge pin cap 30 visible and the control cap 40 separated therefrom.

A mechanism is provided to prevent movement of the hinge pin cap 30 with respect to the control cap 40. A plurality of teeth on the inside surface of the hinge pin cap 30 second cylindrical portion are provided. A plurality of teeth are also provided on the exterior surface of the control cap 40 cylindrical portion so that the teeth engage and mate with each other.

Figure 7A:
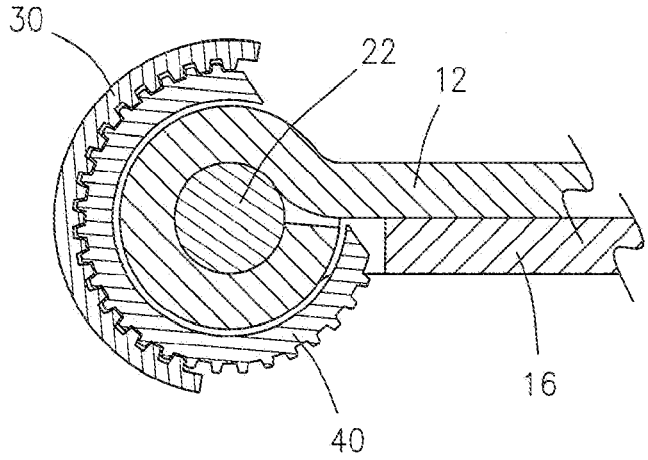
FIGS. 7A, 7B and 7C illustrate alternate positions of the sectional view taken along section line 7-7 of FIG. 3.
Figure 7B:
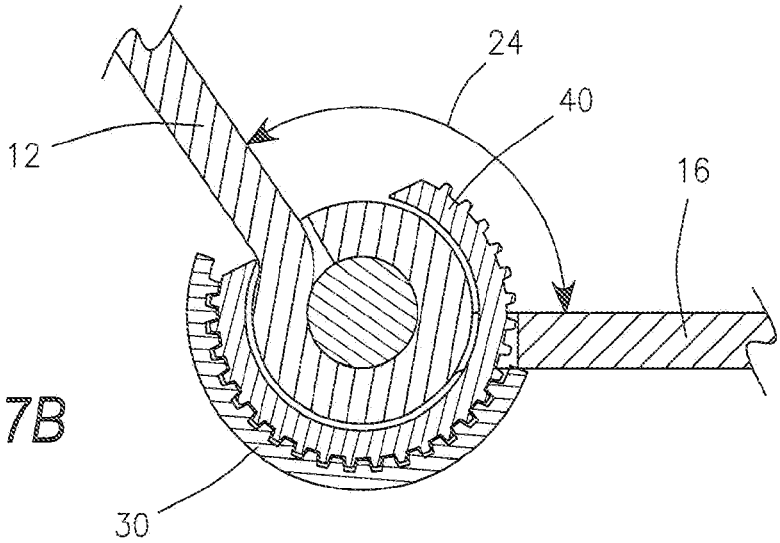
Figure 7C:
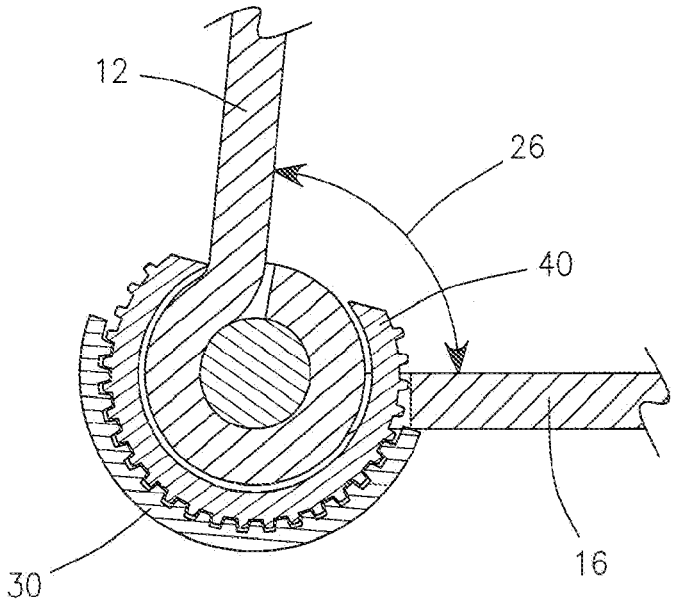

FIGS. 7A, 7B and 7C are sectional views taken along section line 7-7 of FIG. 3 showing the door 14 and hinge 12 in different alternate positions. As best seen in the alternative sectional views 7A, 7B and 7C, a shoulder of the control cap 40 engages the hinge leaf 12 connected to the door (not shown). Additionally, a shoulder of the hinge pin cap 30 engages the hinge pin 16 attached to the doorway (not shown).

The hinge pin cap 30 and the control cap 40 operate together to stop and arrest movement of the door 14 at a desired, selected position prior to either the door or the adjacent wall or doorway being marred.

As seen in FIG. 7A, the door (not shown) is closed with respect to the doorway (not shown) so that the hinge leaf 12 resides against the hinge leaf 16. The hinge cap 30 has been installed with respect to the control cap 40 so that the teeth engage with each other.

When the door begins to open so that the hinge leaf 12 moves in the direction shown by arrow 24 in FIG. 7B, the hinge leaf 12 will move until it engages a shoulder of the control cap 40. Both the control cap 40 and the hinge pin cap 30 will thereafter continue to rotate until the shoulder formed by the opening in the hinge pin cap 30 engages and butts against the hinge leaf 16. Accordingly, the hinge 12 and the door will be prevented from opening past the position as shown in FIG. 7B.

FIG. 7C shows the hinge pin cap 30 installed and mated with the control cap 40 in another alternate position. The door 12 is permitted to move from a closed position to an open position as shown by arrow 26 until the hinge 12 of the door engages the shoulder on the opening of the control cap 40. Thereafter, the hinge leaf 12, the control cap 40 and hinge pin cap 30 will continue to rotate until the shoulder formed by the opening in the hinge pin cap 30 engages in and butts against the hinge leaf 16 of the doorway.

It will be appreciated that in an alternate arrangement (not shown), the control cap 40 would engage the hinge leaf 16 connected to the doorway 18 while the hinge pin cap 32 would engage the hinge leaf 12 connected to the door 14.

Returning to a consideration of FIGS. 1 and 2, a mechanism is provided to prevent any axial movement of the hinge pin 22. A bottom end opposed to the top end of the hinge pin 22 includes a radially enlarged portion 46. The radially enlarged portion is slightly larger than the diameter the openings of the hinge leaves 12 and 16.

A plurality of slots generally parallel to the axis 24 of the hinge pin 22 are provided in the bottom end of the hinge pin 22 extending through. The bottom end, accordingly, may be compressed to allow reduction of the enlarged portion during installation of the hinge pin 22 through the hinge leaves. The bottom end is resilient and, once installed, the radially enlarged portion returns to its normal diameter. Accordingly, the hinge pin 22 will resist being removed from the hinge leaves after installation.

In order to utilize the adjustable door stop system 10 of the present invention, the hinge pin 22 having the hinge pin cap 30 at the top thereof is inserted through the opening in the control cap 40 so that the barrel of the hinge pin 22 is received through the opening of the control cap 40. The teeth of the hinge pin cap will mate with the teeth of the control cap 40 in a selected position to allow the door 12 to open a desired distance.

The bottom end of the hinge pin 22 is then inserted through the hinge leaves 12 and 16.

Figure 8:
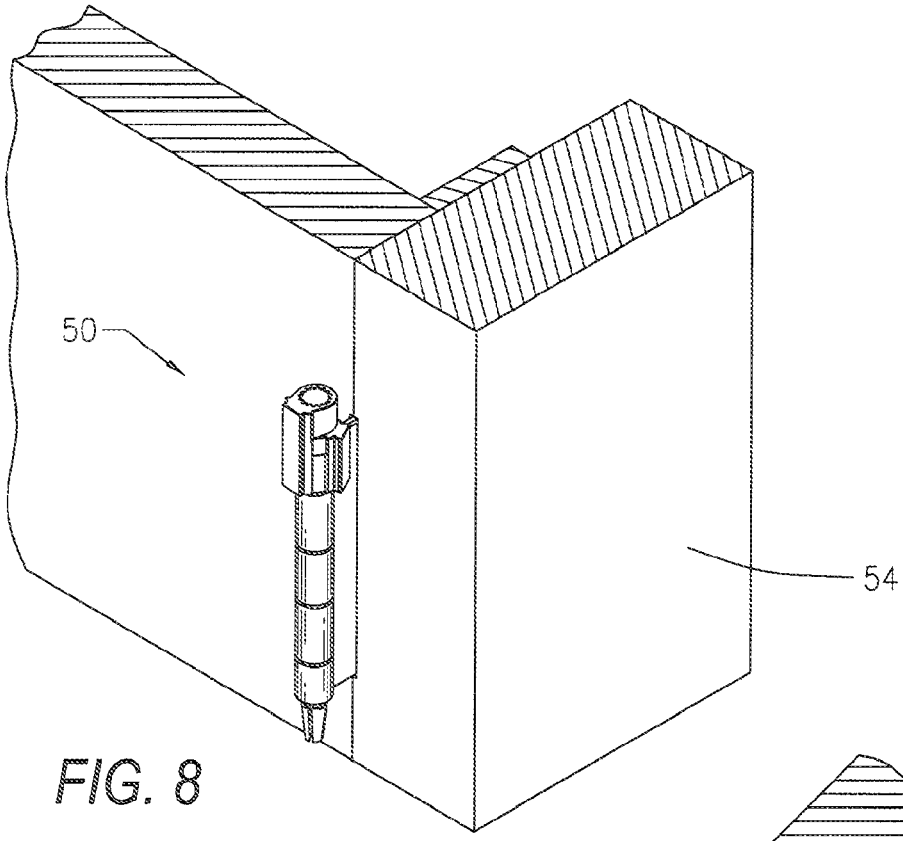
FIGS. 8 and 9 illustrate perspective views of a second preferred embodiment of an adjustable door stop system constructed in accordance with the present invention.
Figure 9:
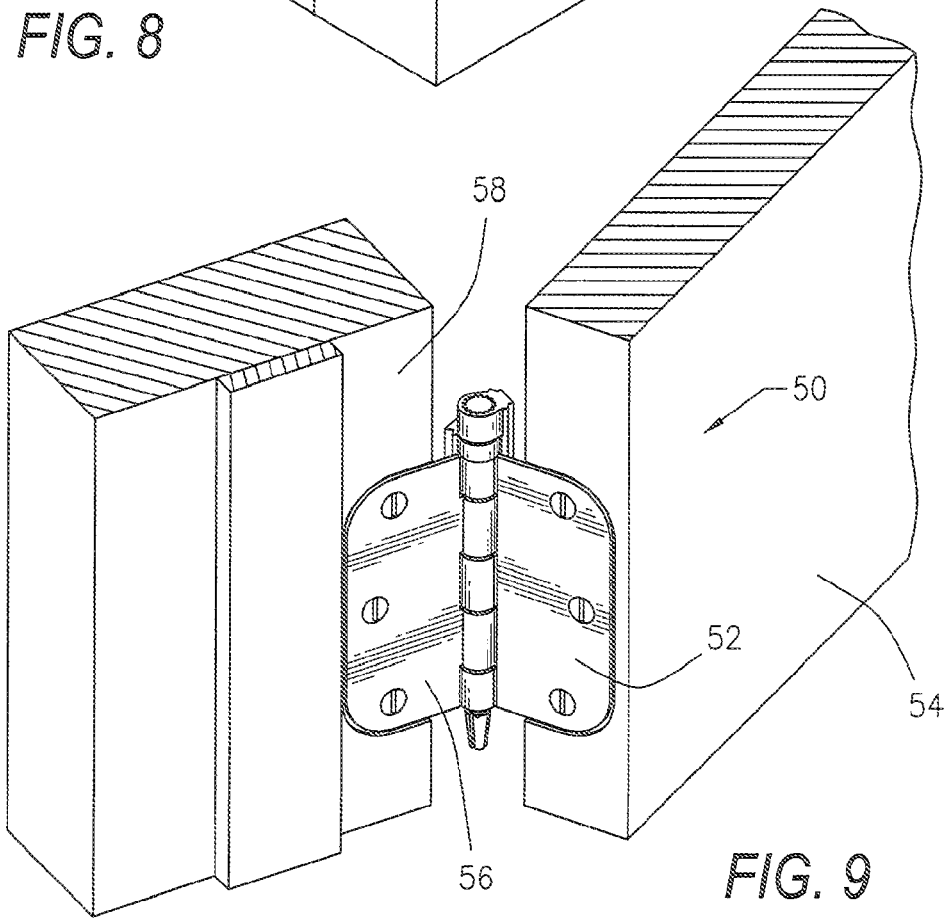

FIGS. 8 and 9 illustrate perspective views of a second preferred embodiment 50 of an adjustable door stop system for a hinge mounted door. FIG. 8 illustrates the door stop system 50 with the door 54 in a closed position while FIG. 9 illustrates the door in an open position.

One hinge leaf 52 would be connected to the door 54 while another hinge leaf 56 would be connected to a doorway 58.

Figure 10:
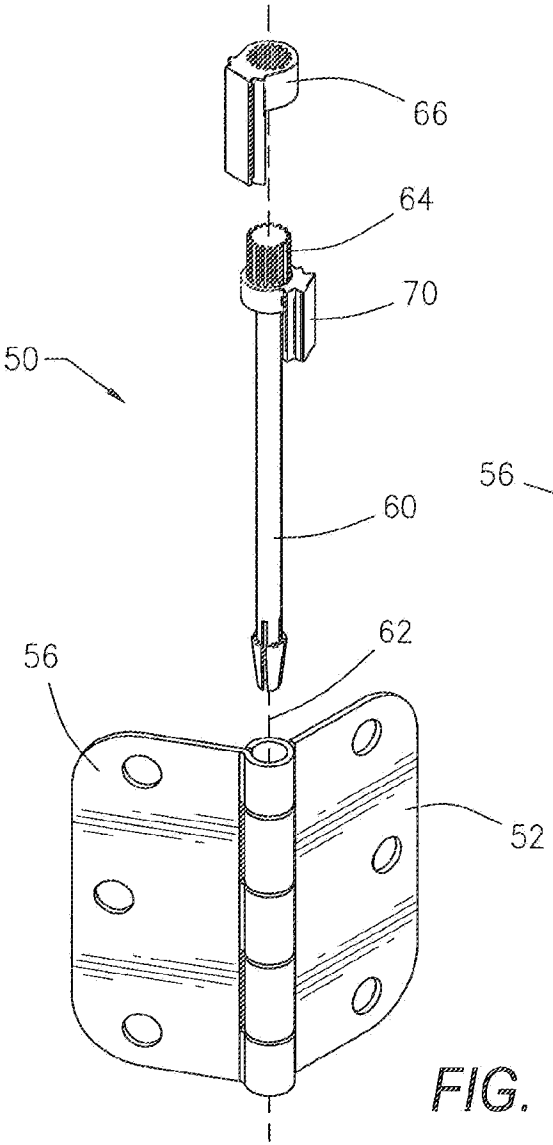
FIG. 10 illustrates an exploded view of the adjustable door stop system shown in FIGS. 8 and 9 apart from the door and doorway.

FIG. 10 illustrates an exploded view of the adjustable door stop system 50 apart from the door and the doorway. The door stop system 50 includes a hinge pin 60 with a cylindrical barrel having an axis 62 (shown by dashed lines) so that the hinge leaves 56 and 58 rotate about the axis.

Figure 12:
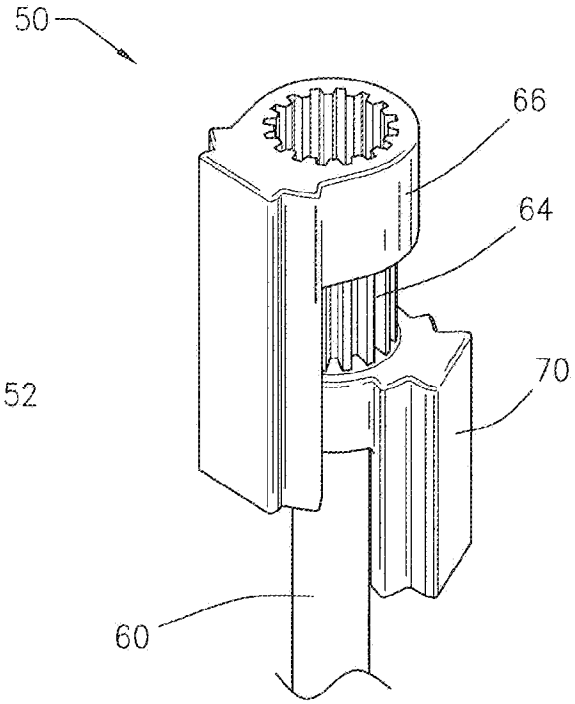
FIG. 12 illustrates a hinge pin and a movement control cap of the embodiment of the adjustable door stop system shown in FIGS. 8 and 9.
Figure 11:
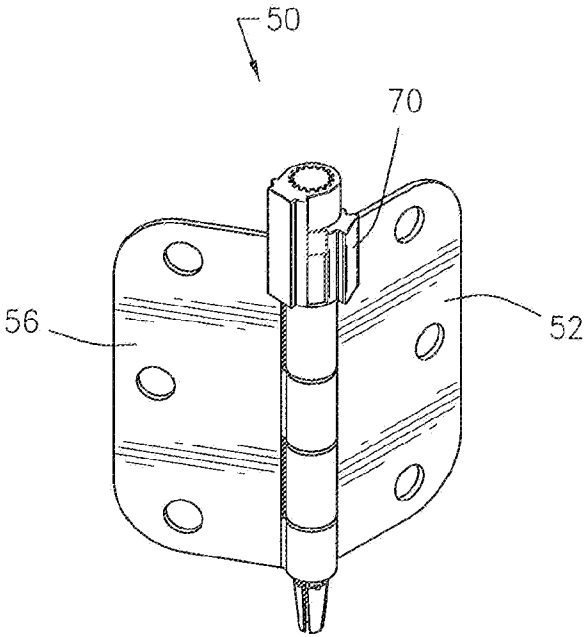
FIG. 11 illustrates a perspective view of the adjustable door stop system shown in FIGS. 8 and 9 apart from the door and the doorway.

FIG. 11 illustrates a perspective view of the adjustable door stop system 50 shown in FIG. 10 fully assembled. FIG. 12 illustrates a portion of the hinge pin 60 with a movement control cap (to be described) partially raised.

As best seen in FIGS. 10 and 12, a first finger 70 extends radially and also axially from a top end of the hinge pin 60. A side of the first finger 70 will engage one of the hinges.

A cylinder 64 extends axially upward from the top of the hinge pin 60 above the level of the first finger 70. The cylinder 64 has a plurality of teeth on the outside surface thereof.

A movement control cap 66 includes a cylindrical opening portion with a plurality of teeth on the inside surface of the cylindrical opening portion. The diameter of the cylindrical opening of the movement control cap 66 is slightly larger than the diameter of the cylinder 64 so that the teeth engage each other.

The movement control cap 66 also includes a second finger 68. The second finger 68 extends radially and also extends axially parallel to the axis of the hinge pin 60. A side of the second finger 68 will engage one of the hinges.

A mechanism is provided to prevent movement of the cylinder 64 with respect to the movement control cap 66 in order to prevent the opening of the door 54 past a desired position. The plurality of teeth on the outside surface of the cylinder 64 mate and engage with a plurality of teeth on the inside surface of the cylinder of the movement control cap 66.

Figure 15A:
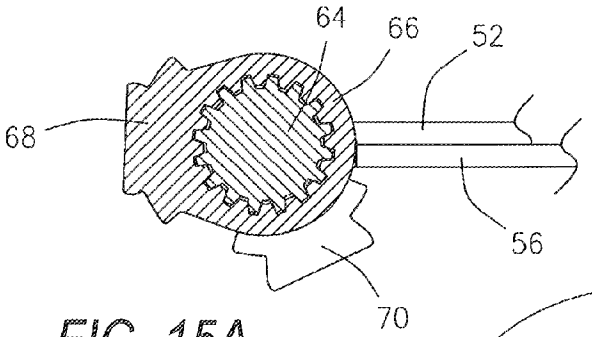
FIGS. 15A, 15B and 15C illustrate alternate positions of the adjustable door stop system taken along section line 15-15 of FIG. 14.
Figure 15B:
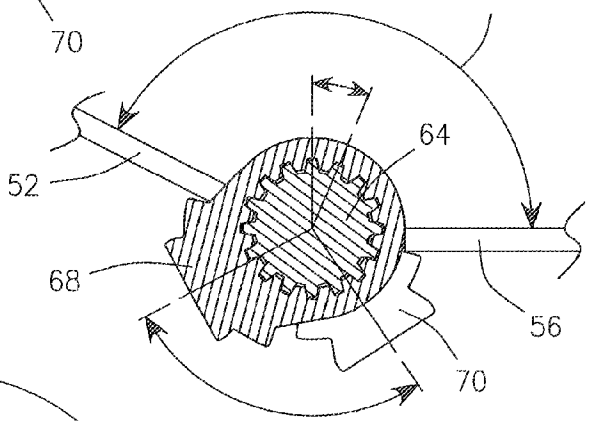
Figure 15C:
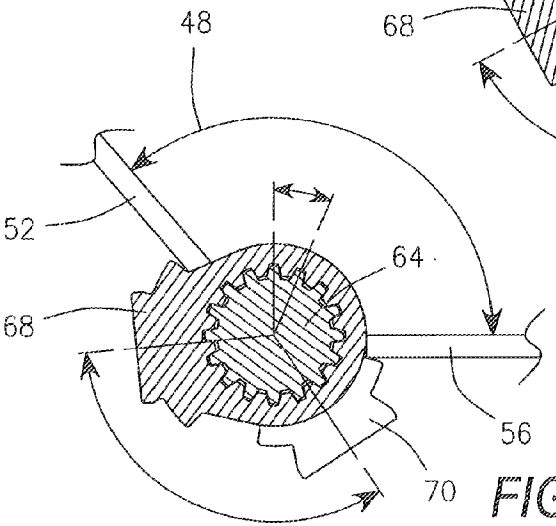
Figure 13:
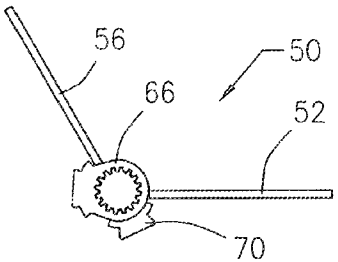
FIG. 13 illustrates a top view and FIG. 14 illustrates a front view of the adjustable door stop system shown in FIGS. 8 and 9 apart from the door and doorway.
Figure 14:
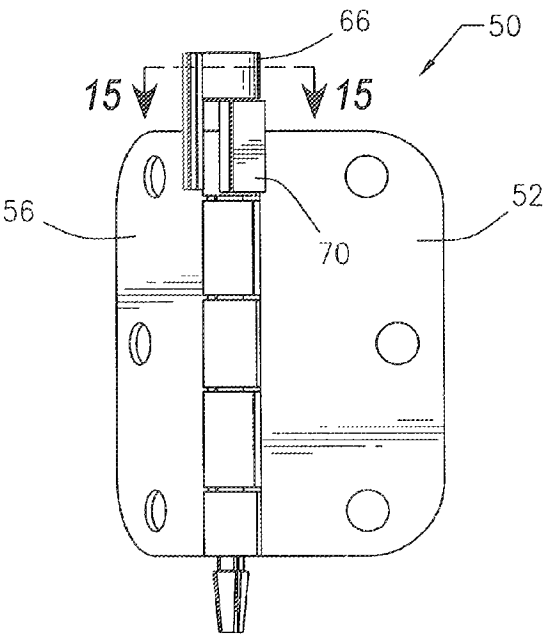

FIGS. 15A, 15B and 15C are sectional views taken along section line 15-15 of FIG. 14 showing the door (not shown) and the hinge 52 in different rotational positions.

As seen in FIG. 15A, the door (not shown) is closed with respect to the doorway (not shown) so that the hinge leaf 52 resides against the hinge leaf 56.

When the (not shown) door begins to open so that the hinge leaf 52 moves as shown by arrow 48 in FIG. 15B, the hinge leaf 52 will move until it engages finger 68.

FIG. 15C shows the movement control cap 66 and second finger 68 installed and mated with the cylinder 64 in another alternate position. The door 12 is permitted to move from a closed position to an open position as shown until the hinge leaf 56 engages the first finger 70. Thereafter, the hinge leaf 52, the movement control cap and first finger 70 will continue to rotate until the shoulder formed by the second finger 68 engages the hinge leaf 52.

Figure 16:
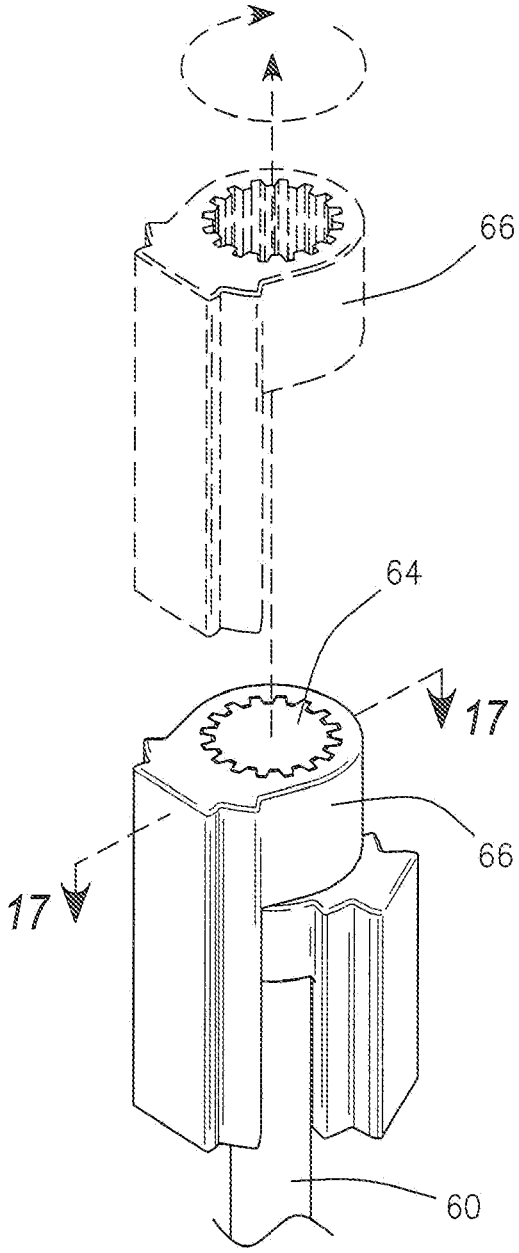
FIG. 16 illustrates a perspective view of a hinge pin and a movement control cap of the adjustable door stop system in a first selected position.
Figure 18:
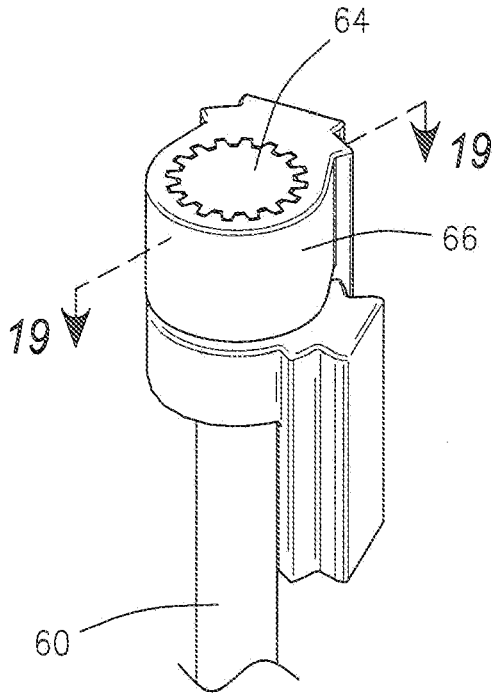
FIG. 18 illustrates a perspective view of a hinge pin and a movement control cap in a second alternate selected position.
Figure 17:
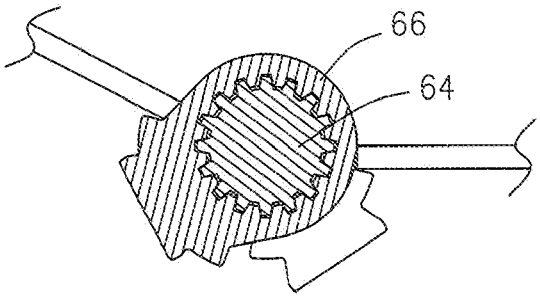
FIG. 17 illustrates a sectional view taken along section line 17-17 of FIG. 16.
Figure 19:
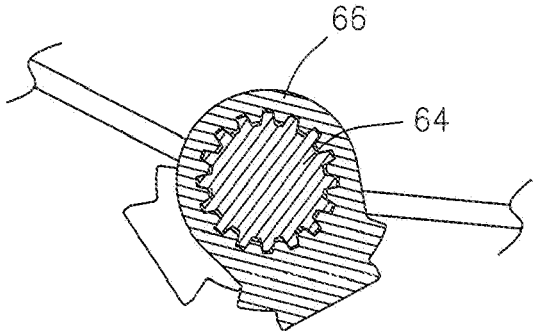
FIG. 19 illustrates a sectional view taken along section line 19-19 of FIG. 18.

FIGS. 16 and 18 show the movement control cap 66 in alternate positions while FIGS. 17 and 19 show sectional views therethrough.

Whereas, the present invention has been described in relation to the drawings attached hereto, it should be understood that other and further modifications, apart from those shown or suggested herein, may be made within the spirit and scope of this invention.

What is claimed is:

1. An adjustable door stop system for a hinge mounted door assembly having at least two hinge leaves respectively connectable to a door and a doorway, said door stop system comprises:

a hinge pin having an axis about which said hinge leaves rotate, said hinge pin further comprising a bottom end and an opposed top end;

a first finger extending radially from said top end of said hinge pin, said first finger being substantially parallel to said axis of said hinge pin;

a cylinder extending axially from said hinge pin top end above said first finger; and a movement control cap having a cylindrical open portion with an interior surface engaged with an exterior surface said cylinder, said movement control cap having a second finger extending axially from said cylindrical portion, said second finger being substantially parallel to said axis of said hinge pin.

2. An adjustable door stop system set forth in claim 1 wherein said exterior surface of said cylinder includes a plurality of teeth and said interior surface of said movement control cap cylindrical open portion includes a plurality of teeth, and said teeth of said exterior surface of said cylinder engage and mate with said teeth of said interior surface of said cylindrical open portion of said movement control cap.

3. An adjustable door stop system as set forth in claim 1 including means to prevent axial movement of said hinge pin a the bottom end of said hinge pin.

4. An adjustable door stop system as set forth in claim 3 wherein said means to prevent axial movement of said hinge pin includes a radially enlarged portion of said hinge pin bottom end.

5. An adjustable door stop system as set forth in claim 4 including a plurality of slots in said radially enlarged portion of said hinge pin bottom end to allow compression during installation.

6. An adjustable door stop system for a hinge mounted door, which door stop system comprises:

at least two opposing door hinge leaves, a first of said hinge leaves connectable to a door and a second of said hinge leaves connectable to a doorway;

a hinge pin having an axis about which said hinge leaves rotate, said hinge pin further comprising a bottom end and an opposed top end;

a radially enlarged portion of said hinge pin bottom end including a plurality of slots therein generally parallel to said axis to allow compression during installation;

a movement control cap having a cylindrical open portion with an interior surface engaged with an exterior surface of a cylinder extending axially above said hinge pin top end; and at least one first finger extending radially from said top end of said hinge pin and being capable of engaging said first of said hinge leaves, and at least one second finger extending axially from said movement control cap and being capable of engaging said second of said hinge leaves.

7. The door stop of claim 6 further comprising said cylinder extending axially from said hinge pin top end above said first finger.

8. The door stop system of claim 6 wherein said exterior surface of said cylinder includes a plurality of teeth and said interior surface of said movement control cap cylindrical open portion includes a plurality of teeth, and said teeth of said exterior surface of said cylinder engage and mate with said teeth of said interior surface of said cylindrical open portion of said movement control cap.

* * * * *